US011932971B2

(12) United States Patent
Horinouchi et al.

(10) Patent No.: US 11,932,971 B2
(45) Date of Patent: Mar. 19, 2024

(54) METHOD OF PRODUCING PRECURSOR FIBER FOR CARBON FIBER AND CARBON FIBER

(71) Applicant: Toray Industries, Inc., Tokyo (JP)

(72) Inventors: Ayanobu Horinouchi, Otsu (JP); Fumitaka Watanabe, Otsu (JP); Yuuki Okishima, Ehime (JP)

(73) Assignee: Toray Industries, Inc., Tokyo (JP)

( * ) Notice: Subject to any disclaimer, the term of this patent is extended or adjusted under 35 U.S.C. 154(b) by 413 days.

(21) Appl. No.: 17/287,510

(22) PCT Filed: Oct. 24, 2019

(86) PCT No.: PCT/JP2019/041603
§ 371 (c)(1),
(2) Date: Apr. 21, 2021

(87) PCT Pub. No.: WO2020/090597
PCT Pub. Date: May 7, 2020

(65) Prior Publication Data

US 2021/0395924 A1 Dec. 23, 2021

(30) Foreign Application Priority Data

Oct. 29, 2018 (JP) ..... 2018-202504
Feb. 27, 2019 (JP) ..... 2019-033752

(51) Int. Cl.
*D01F 9/22* (2006.01)
*D01F 6/18* (2006.01)
*D01F 9/32* (2006.01)

(52) U.S. Cl.
CPC ..... *D01F 9/22* (2013.01); *D01F 6/18* (2013.01); *D01F 9/328* (2013.01)

(58) Field of Classification Search
CPC ..... D01F 9/22; D01F 6/18; D01F 9/328
See application file for complete search history.

(56) References Cited

U.S. PATENT DOCUMENTS 6,218,460 B1 * 4/2001 Shin ..... D01D 5/11 524/544
2010/0003515 A1 * 1/2010 Tanaka ..... D01F 6/18 526/341
2014/0232036 A1 8/2014 Inada et al.

FOREIGN PATENT DOCUMENTS

JP 59-21709 A 2/1984
JP 61-119708 A 6/1986
(Continued)

OTHER PUBLICATIONS

JP2001049524A machine translation accessed on ESpaceNet Aug. 3, 2023. (Year: 2001).*

*Primary Examiner* — Alison L Hindenlang
*Assistant Examiner* — Erica Hartsell Funk
(74) *Attorney, Agent, or Firm* — DLA Piper LLP (US)

(57) ABSTRACT

A method of producing a precursor fiber for carbon fiber includes extruding a polyacrylonitrile copolymer solution from a spinneret into the air, immersing it in a coagulation bath liquid stored in a coagulation bath, redirecting traveling of the coagulating fiber bundle by a first guide immersed in the coagulation bath disposed below the spinneret, and pulling it out of the coagulation bath liquid into the air to prepare a coagulated fiber bundle, which is then subjected to at least a washing step in water, stretching step, oil agent applying step, and drying step, wherein the depth-directional coagulation bath immersion length, which means a distance between the starting point of the immersion of the spinning dope solution in the coagulation bath liquid and the first guide immersed in the coagulation bath where traveling of the coagulating fiber bundle is redirected, is 3 to 40 cm.

10 Claims, 1 Drawing Sheet

(56) References Cited

FOREIGN PATENT DOCUMENTS

| | | | |
|---|---|---|---|
| JP | 10-219516 | A | 8/1998 |
| JP | 2001-49524 | A | 2/2001 |
| KR | 10-1401148 | B1 | 5/2014 |
| KR | 10-2018-87545 | | 8/2018 |
| WO | 2008/047745 | A1 | 4/2008 |
| WO | 2013/047437 | A1 | 4/2013 |

* cited by examiner

METHOD OF PRODUCING PRECURSOR FIBER FOR CARBON FIBER AND CARBON FIBER

TECHNICAL FIELD

This disclosure relates to carbon fiber that can be used suitably for manufacturing aircraft members, automobile members, and ship members, as well as sporting goods such as golf shafts and fishing rods and other general industrial applications.

BACKGROUND

Being higher in specific strength and specific modulus than other fibers, carbon fiber has been used widely as a reinforcing fiber for composite materials in conventional sporting goods, aviation and aerospace products, automobiles, civil engineering and construction materials, and other general industrial products such as pressure vessels and windmill blades. There is an increasing need for both further improved productivity and high performance.

In polyacrylonitrile (occasionally abbreviated as PAN) based carbon fiber, which is the most widely used carbon fiber, the industrial production process includes a step of spinning a spinning dope solution containing a precursory PAN copolymer mainly by the dry-jet wet spinning technique to produce a precursor fiber for carbon fiber, a step of heating it in an oxidizing atmosphere at 200° C. to 300° C. to convert it into a stabilized fiber, and a step of heating it in an inert atmosphere at at least 1,200° C. to carbonize it, which are carried out in this order. Improvement in the productivity of a PAN-based carbon fiber can be achieved in any of the step of production of precursor fiber for carbon fiber, the step of stabilization, or the step of carbonization. Useful spinning methods that can be applied to the step of production of a precursor fiber for carbon fiber include the wet spinning technique, dry jet wet spinning technique, and dry spinning technique, of which the dry-jet wet spinning technique, compared to the other spinning techniques, has been in wider use because it permits an increased take-up speed and produces high-strength carbon fibers, thus ensuring both an increased productivity and enhanced performance.

In a dry jet wet spinning process, a spinning dope solution is extruded through a spinneret into a gaseous atmosphere (air gap) and introduced into a coagulation bath, in which the take-up direction is changed by a guide immersed in the coagulation bath provided at the bottom of the coagulation bath. Then, the resulting coagulated fiber bundle, from which a precursor fiber for carbon fiber is to be produced, is pulled out of the coagulation bath by a take-up roller.

If the coagulated fiber bundle take-up speed is increased, it can increase the flows of coagulation bath liquid generated by traveling of the coagulating fiber bundle (referred to as accompanying flow) and cause fluctuations of the liquid level of the coagulation bath, possibly leading to a break of the fiber bundle. In addition to increasing the take-up speed, increasing the number of spinneret holes also improves productivity, but the resulting increase in the number of filaments increases the accompanying flow, possibly leading to similar limits to those described above. Specifically, the aforementioned limits to productivity improvement exists when a precursor fiber for carbon fiber is produced by the dry-jet wet spinning technique Some proposals have been made to achieve high speed spinning of PAN based fiber to produce a precursor fiber for carbon fiber. International Publication WO 2008/047745 proposes a technique that uses a PAN copolymer having a specific molecular weight distribution to ensure an increased spinning tension and prevent a break of the coagulating fiber bundle. Japanese Unexamined Patent Publication (Kokai) No. SHO-59-21709 proposes a technique that uses a flow down type coagulation bath to minimize the coagulation bath resistance, thereby increasing the take-up speed. International Publication WO 2013/047437 proposes a technique that uses a porous plate designed to surround entirely or partially the coagulating fiber bundle after being spun down from the spinneret, thereby preventing fluctuations of the liquid level or swinging motions of the coagulating fiber bundle.

However, although able to enhance the speed, it is necessary for the technique proposed in International Publication WO 2008/047745 to use a PAN copolymer of a specific type. The technique proposed in Japanese Unexamined Patent Publication (Kokai) No. SHO-59-21709 has some disadvantages such as low industrial practicality because of the necessity of a coagulation bath of a complicated structure and a decreased process operability because of the necessity of great skill for threading operation at the time of equipment startup. It is impossible for International Publication WO 2013/047437 to achieve significant productivity improvement because it cannot work effectively enough in preventing a fall of the liquid level and accordingly the spinning dope solution extruded from the spinneret is likely to be broken in the air gap. Thus, it is impossible for any of the conventionally known methods to work sufficiently to produce a precursor fiber for carbon fiber with high productivity.

Under such circumstances, it could be helpful to provide a method of producing a precursor fiber for carbon fiber that can perform spinning while preventing the spinning dope solution extruded from the spinneret from being broken in the air gap and preventing the coagulating fiber bundle from being broken in the coagulation bath liquid even when the spinning speed is increased or the number of spinneret holes is increased, and also provide a carbon fiber produced thereby.

SUMMARY

We thus provide a method of producing a precursor fiber for carbon fiber that includes steps of extruding a polyacrylonitrile copolymer solution from a spinneret into the air, immersing it in a coagulation bath liquid stored in a coagulation bath, redirecting the traveling of the coagulating fiber bundle by a first guide immersed in the coagulation bath disposed below the spinneret, and pulling it out of the coagulation bath liquid into the air to prepare a coagulated fiber bundle, which is then subjected to at least a washing step in water, stretching step, oil agent applying step, and drying step, wherein the depth-directional coagulation bath immersion length, which means the distance between the starting point of the immersion of the spinning dope solution in the coagulation bath liquid and the first guide immersed in the coagulation bath where the traveling of the coagulating fiber bundle is redirected, is 3 to 40 cm.

The production method preferably is further characterized in that the coagulation bath immersion length, which is the sum of the depth-directional coagulation bath immersion length and the oblique-directional coagulation bath immersion length, is 10 to 500 cm, the oblique-directional coagulation bath immersion length being the distance between the first guide immersed in the coagulation bath where the traveling of the coagulating fiber bundle is redirected and the exit point where it is pulled out into the air.

The production method preferably is further characterized in that the coagulating fiber bundle that is redirected by the first guide immersed in the coagulation bath is redirected again at least by a second guide immersed in the coagulation bath, wherein the second guide immersed in the coagulation bath is located in the coagulation solution below the straight line running from the exit point where the coagulating fiber bundle is pulled out into the air to the first guide immersed in the coagulation bath.

The carbon fiber production method is also characterized in that the preparation of a precursor fiber for carbon fiber by the aforementioned production method for a precursor fiber for carbon fiber is followed by subjecting it to stabilization treatment in an oxidizing atmosphere at a temperature of 200° C. to 300° C., subjecting it to preliminary carbonization treatment in an inert atmosphere at a temperature of 500° C. to 1,200° C., and then subjecting it to carbonization treatment in an inert atmosphere at a temperature of 1,200° C. to 3,000° C.

We can thus perform stable spinning while preventing the spinning dope solution extruded from the spinneret from being broken in the air gap and preventing the coagulating fiber bundle from being broken in the coagulation bath liquid even when the spinning speed is increased and produce a high quality precursor fiber for carbon fiber and a high quality carbon fiber.

EXPLANATION OF NUMERALS

Figure 1:
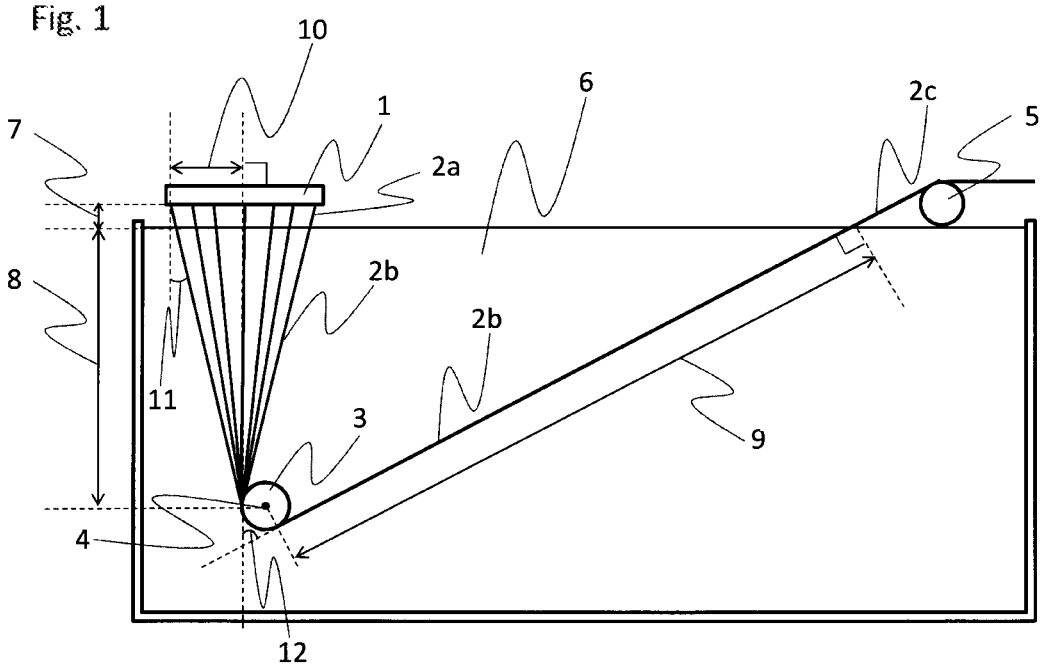
FIG. 1 is a side cross section view illustrating implementation of a typical production method of a precursor fiber for carbon fiber according to a first preferred example.

1 spinneret
2*a* spinning dope solution
2*b* coagulating fiber bundle
2*c* coagulated fiber bundle
3 first guide immersed in the coagulation bath
4 center of the first guide immersed in the coagulation bath
5 take-up guide part
6 coagulation bath liquid
7 air gap length
8 depth-directional coagulation bath immersion length
9 oblique-directional coagulation bath immersion length
10 distance from the spinneret hole located outermost in the take-up direction to the spinneret center
11 angle (A) between the straight line running from the spinneret hole located outermost in the take-up direction to the redirection point of the spinning dope solution on the guide immersed in the coagulation bath and the straight line perpendicular to the spinneret face
12 redirection angle (B) in the example (1)
13 first oblique-directional coagulation bath immersion length
14 second guide immersed in the coagulation bath
15 center of the second guide immersed in the coagulation bath
16 redirection angle (B) in the example (2)
17 depth of second guide immersed in the coagulation bath
18 second oblique-directional coagulation bath immersion length

DETAILED DESCRIPTION

We discovered a method that produces a precursor fiber for carbon fiber while preventing the spinning dope solution extruded from the spinneret from being broken in the air gap and preventing the coagulating fiber bundle from being broken in the coagulation bath liquid even when the number of spinneret holes is large or the take-up speed is high.

Production Method of Precursor Fiber for Carbon Fiber

FIG. 1 shows a side cross section view illustrating the structure of a typical dry jet wet spinning apparatus according to a first preferred example. The first preferred example will be occasionally referred to simply as the example (1). In the figure, the number 1 denotes the spinneret; 2*a* denotes the spinning dope solution; 2*b* denotes the fiber bundle in which the spinning dope solution is being coagulated (2*b* will be occasionally referred to as coagulating fiber bundle); 2*c* denotes the coagulated fiber bundle; 3 denotes the first guide immersed in the coagulation bath in the coagulation bath liquid; 4 denotes the central point of the first guide immersed in the coagulation bath 3 (4 will be occasionally referred to as center of the first guide immersed in the coagulation bath); 5 denotes the take-up guide part; 6 denotes the coagulation bath liquid; 7 denotes the air gap length; 8 denotes the depth-directional coagulation bath immersion length; 9 denotes the oblique-directional coagulation bath immersion length; 10 denotes the distance from the spinneret hole located outermost in the take-up direction to the spinneret center; 11 denotes the angle (A) between the straight line running from the spinneret hole located outermost in the take-up direction to the redirection point of the spinning dope solution on the first guide immersed in the coagulation bath and the straight line perpendicular to the spinneret face; 12 denotes the redirection angle (B) between the straight line running from the spinneret center to the redirection point of the spinning dope solution on the first guide immersed in the coagulation bath and the straight line running from the redirection point of the spinning dope solution on the first guide immersed in the coagulation bath to the take-up guide part 5 (12 will be occasionally referred to as the redirection angle (B) in the example (1)). 2*a*, 2*b*, and 2*c* form a continuous body and occupy different parts as follows: 2*a* is the part from the spinneret to the point of entering into coagulation bath liquid; 2*b* is the part from the point of entering into coagulation bath liquid to the point of exit out of the coagulation bath liquid; and 2*c* is the part after the point of exit out of the coagulation bath liquid.

After being extruded from the spinneret 1, the spinning dope solution 2*a* enters the coagulation bath liquid to become a coagulating fiber bundle 2*b*, travels down in the coagulation bath liquid and then toward the take-up guide part 5 by way of the underwater guide 3. The coagulating fiber bundle is a fiber bundle in which the spinning dope solution is being coagulated. More specifically, in a spinning dope solution in this state, at least the surface is coagulated as a result of immersion in the coagulation bath liquid and it is in the process of coagulation as the spinning solvent is extracted in the coagulation bath liquid. Note that coagulation may be completed before it exits out of the coagulation bath liquid depending on the conditions, but it is called the coagulating fiber bundle while it stays within the coagulation bath liquid.

In example (1), the coagulation bath immersion length is the sum of the depth-directional coagulation bath immersion length 8 and the oblique-directional coagulation bath immersion length 9.

The depth-directional coagulation bath immersion length 8 is the vertical distance from the liquid surface of the coagulation bath liquid to the center 4 of the first guide immersed in the coagulation bath and can be determined by, for example, measurement with a tape measure. When the spinning speed is high, the liquid surface of the coagulation bath liquid immediately below the spinneret may be dragged down by the traveling coagulating fiber bundle, but the original liquid surface is assumed to represent the surface of the coagulation bath liquid.

Furthermore, the oblique-directional coagulation bath immersion length 9 means that part of the straight line showing the traveling path of the coagulating fiber bundle running from the first guide immersed in the coagulation bath 3 to the take-up guide part 5 which is defined by the closest position from the center 4 of the first guide immersed in the coagulation bath and the intersection between the straight line and the liquid surface, and it can be determined by, for example, measurement with a tape measure. When the spinning speed is high, the liquid surface may be dragged up by the coagulating fiber bundle exiting out of the coagulation bath liquid into the air, but the original liquid surface is assumed to represent the surface of the coagulation bath liquid.

Figure 2:
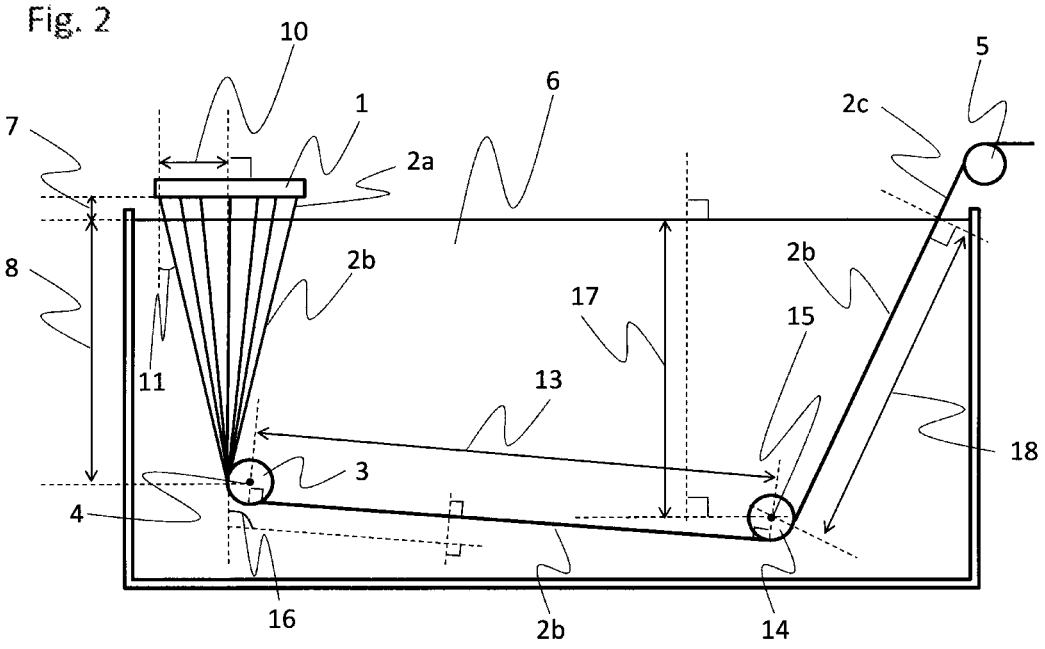
FIG. 2 is a side cross section view illustrating implementation of a typical production method of a precursor fiber for carbon fiber according to a second preferred example.

FIG. 2 shows a side cross section view illustrating the structure of a typical dry jet wet spinning apparatus according to a second preferred example. The second preferred example will be occasionally referred to simply as the example (2). In the example (2), the spun state of the spinning dope solution 2*a* extruded from the spinneret 1 and reaching the first guide immersed in the coagulation bath 3 in the form of a coagulating fiber bundle 2*b* is the same as in the example (1). In FIG. 2, the number 13 denotes the first oblique-directional coagulation bath immersion length, 14 the second guide immersed in the coagulation bath, 15 the center of the second guide immersed in the coagulation bath, 16 the redirection angle (B) according to the example (2), which is the angle between the straight line running from the spinneret center to the point of redirection of the coagulating fiber bundle 2*b* on the first guide immersed in the coagulation bath and the straight line running from the point of redirection of the coagulating fiber bundle 2*b* on the first guide immersed in the coagulation bath to the second guide immersed in the coagulation bath 14 (16 will be occasionally referred to as the redirection angle (B) according to the example (2)), 17 the depth of the second guide immersed in the coagulation bath, and 18 the second oblique-directional coagulation bath immersion length.

The depth-directional coagulation bath immersion length 8 in the example (2) means the same as in the example (1). The second guide immersed in the coagulation bath 14 in the example (2) is located in the coagulation solution below the straight line running from the point where the coagulating fiber bundle is pulled out into the air to the first guide immersed in the coagulation bath. The first oblique-directional coagulation bath immersion length 13 in the example (2) means the length of the line segment running from the center 4 of the first guide immersed in the coagulation bath to the center 15 of the second guide immersed in the coagulation bath and can be determined by, for example, measurement with a tape measure. The second oblique-directional coagulation bath immersion length 18 means that part of the straight line showing the traveling path of the coagulating fiber bundle running from the second guide immersed in the coagulation bath 14 to the take-up guide part 5 which is defined by the closest position from the center 15 of the second guide immersed in the coagulation bath and the intersection between the straight line and the liquid surface, and it can be determined by, for example, measurement with a tape measure. When the spinning speed is high, the liquid surface may be dragged up by the coagulating fiber bundle exiting out of the coagulation bath liquid into the air, but the original liquid surface is assumed to represent the surface of the coagulation bath liquid. In addition, the depth 17 of the second guide immersed in the coagulation bath means the vertical distance from the center 15 of the second guide immersed in the coagulation bath to the coagulation liquid surface and can be determined by, for example, measurement with a tape measure.

The depth-directional coagulation bath immersion length 8 in the example (1) is 3 to 40 cm. A decrease in the depth-directional coagulation bath immersion length 8 reduces accompanying flow in the depth direction of the coagulation bath to prevent a break of the coagulating fiber bundle, but if it is too short, it causes an excessive decrease in the distance between the coagulating fiber bundle traveling in an oblique direction from the first guide immersed in the coagulation bath 3 and the liquid surface of the coagulation bath liquid, leading to a significant fluctuation of the liquid surface near the spinneret to cause a variation of fineness. Accordingly, the depth-directional coagulation bath immersion length 8 is preferably 3 to 30 cm, more preferably 4 to 25 cm, and still more preferably 5 to 20 cm.

In addition, if the oblique-directional coagulation bath immersion length 9 is shortened in the example (1), it suppresses accompanying flow in the oblique direction to decrease the fluctuation of the liquid surface, but the contact angle between the coagulating fiber bundle 2*b* and the first guide immersed in the coagulation bath 3 will widen to increase the guide resistance on the first guide immersed in the coagulation bath 3, possibly causing a break of the coagulating fiber bundle on the guide part. Accordingly, the coagulation bath immersion length is preferably 10 to 500 cm, more preferably 15 to 300 cm, and still more preferably 20 to 200 cm.

The redirection angle (B) in the example (1) is preferably 70° to 89°, more preferably 75° to 89°, and still more preferably 80° to 89°. If the redirection angle (B) in the example (1) is too small, it reduces the distance from the coagulating fiber bundle 2*b* traveling from the first guide immersed in the coagulation bath 3 toward the take-up guide part 5 to the liquid surface of the coagulation bath liquid to cause a fluctuation of the liquid surface, possibly leading to a variation of fineness and a break of the coagulating fiber bundle, whereas if it is too large, it will require a large sized coagulation bath. The redirection angle (B) in the example (1) is calculated as described below.

Redirection angle (*B*) in example (1)=arccos(depth-directional coagulation bath immersion length/oblique-directional coagulation bath immersion length)

For the example (2) as well, the depth-directional coagulation bath immersion length 8 is 3 to 40 cm. A decrease in the depth-directional coagulation bath immersion length reduces accompanying flow in the depth direction of the coagulation bath to prevent a break of the coagulating fiber bundle, but if it is too short, it causes an excessive decrease in the distance between the coagulating fiber bundle traveling from the first guide immersed in the coagulation bath 3 toward the second guide immersed in the coagulation bath and the liquid surface of the coagulation bath liquid, leading to a significant fluctuation of the liquid surface near the spinneret to cause a variation of fineness. Accordingly, the depth-directional coagulation bath immersion length is preferably 3 to 30 cm, more preferably 4 to 25 cm, and still more preferably 5 to 20 cm.

Compared to this, a decrease in the first oblique-directional coagulation bath immersion length 13 is preferred in the example (2) because it reduces accompanying flow in the oblique direction to suppress the fluctuation of the liquid surface and also because it permits a decrease in the size of the coagulation bath, although a fluctuation of the liquid surface will be caused near the spinneret if it is too short. Accordingly, the first oblique-directional coagulation bath immersion length 13 is preferably 10 to 300 cm, more preferably 10 to 250 cm, and still more preferably 10 to 150 cm. The second oblique-directional coagulation bath immersion length 18 depends solely on the position of the second guide immersed in the coagulation bath 14 and the position of the take-up guide part 5. There are no specific limitations on the positions of the two guide parts and they may be fixed appropriately in consideration of process operability. To enhance the effect of the example (2), however, it is preferable for them to be located in the coagulation solution below the straight line running from the point where the coagulating fiber bundle is pulled out of the coagulation bath liquid into the air to the first guide immersed in the coagulation bath.

The redirection angle (B) in the example (2) is preferably 70° to 150°, more preferably 80° to 140°, and still more preferably 90° to 130°. If the redirection angle (B) is too small, it reduces the distance between the coagulating fiber bundle traveling from the first guide immersed in the coagulation bath toward the second guide immersed in the coagulation bath and the liquid surface of the coagulation bath liquid to cause a fluctuation of the liquid surface, possibly leading to a variation of fineness and a break of the coagulating fiber bundle, whereas if it is too large, it increases accompanying flow in the depth direction immediately below the spinneret, resulting in a fluctuation of the liquid surface to cause a variation of fineness or a break of the coagulating fiber bundle. An arrangement in which the redirection angle (B) is smaller than 90° can be realized in the example (1), but as the redirection angle (B) becomes closer to 90°, the coagulation bath has to be increased in size in the example (1), whereas it is not necessary for the size of the coagulation bath to be changed depending on the redirection angle (B) in the example (2), which is the major difference. The redirection angle (B) in the example (2) is calculated as described below.

Redirection angle (*B*) in example (2)=arccos{(depth-directional coagulation bath immersion length−depth of second guide immersed in the coagulation bath)/first oblique-directional coagulation bath immersion length}

The example (2) is advantageous over the example (1) in that the redirection angle (B) on the first guide immersed in the coagulation bath can be increased to a large value so that the distance between the coagulating fiber bundle traveling toward the take-up guide part and the liquid surface can be increased compared to the example (1), thus serving to improve the spinnability. It is also advantageous in providing a yarn with improved quality because a larger redirection angle (B) reduces the friction resistance on the first guide immersed in the coagulation bath. Accordingly, it is good to install a second guide immersed in the coagulation bath with the aim of increasing the redirection angle (B) on the first guide immersed in the coagulation bath, and a third guide immersed in the coagulation bath and a fourth guide immersed in the coagulation bath may be added to control the traveling of the coagulating fiber bundle.

Polyacrylonitrile Copolymer Solution

The polyacrylonitrile copolymer present in the polyacrylonitrile copolymer solution is a polyacrylonitrile, a copolymer containing a polyacrylonitrile as primary component, or a mixture containing any of them as primary component. Polyacrylonitrile will be occasionally abbreviated as PAN. The term "primary component" refers to a component that accounts for 60 mass % or more in a mixture or in a copolymer. There are no specific limitations on the solvent used for the PAN copolymer solution as long as it can dissolve the PAN copolymer, and useful examples include dimethyl sulfoxide, dimethyl formamide, dimethyl acetamide, aqueous zinc chloride solution, and aqueous sodium thiocyanate solution. There are no specific limitations on the temperature of the PAN copolymer solution at the time of extrusion from the spinneret, and an appropriate temperature may be adopted to ensure stable extrusion.

Spinneret

It is preferable for a spinneret to have 500 to 24,000 holes. If the number of holes is less than 500, it is necessary to install many spinnerets, leading to a decrease in the process operability due to, for example, threading operation in case of troubles. If the number of holes is more than 24,000, on the other hand, the spinneret will be so large that a variation of fineness is likely to occur between the central portion and the circumferential portion of the spinneret. The region containing the spinneret holes may have a circular, rectangular, or annular shape. In a rectangle, it has long sides and short sides, and commonly, short sides are set in the yarn bundle take-up direction. The size of the spinneret in the take-up direction is preferably 5 to 20 cm. The size of the spinneret in the take-up direction means the distance between the front outermost hole and the rear outermost hole in the traveling direction of the coagulating fiber bundle, which is running toward the take-up guide part after being introduced into the coagulation bath liquid as a spinning dope solution and redirected by the guide immersed in the coagulation bath, and it can be determined by, for example, measurement with a tape measure. As the size of the spinneret in the take-up direction becomes smaller, the extrusion angle of the PAN copolymer solution can be made smaller to ensure stabler take-up, whereas the number of spinneret holes decreases to deteriorate the productivity. Accordingly, it is preferably 6 to 17 cm, more preferably 8 to 15 cm.

Coagulation Bath Liquid

The coagulation bath liquid preferably has a viscosity of 2 to 100 mPa·s. If the viscosity of the coagulation bath liquid is too low, the resulting coagulated fiber will be low in denseness, leading to a final carbon fiber product with poor physical properties. The coagulation bath liquid is occasionally referred to as coagulation bath, following general usage. The effect will be enhanced as the viscosity increases, but if the viscosity becomes too high, strong accompanying flow will occur to cause a yarn break. Accordingly, the viscosity of the coagulation bath liquid is more preferably 6 to 80 mPa·s, still more preferably 10 to 50 mPa·s.

In addition, the temperature of the coagulation bath liquid is preferably −40° C. to 80° C. As the temperature of the coagulation bath liquid decreases, the resulting coagulated fiber improves in denseness, leading to a final carbon fiber product with better physical properties, but if the temperature of the coagulation bath liquid is too low, it can cause an excessive increase in the viscosity of the coagulation bath liquid, possibly leading to excessively strong accompanying flow that may cause a break of the spinning dope solution in the air gap or a break of the coagulating fiber bundle. Accordingly, the temperature of the coagulation bath liquid is more preferably −20° C. to 50° C., still more preferably −5° C. to 15° C.

A mixture prepared by mixing a PAN copolymer solvent such as dimethyl sulfoxide, dimethyl formamide, dimethyl acetamide, aqueous zinc chloride solution, and aqueous sodium thiocyanate solution, which are cited above as useful solvents for preparation of PAN copolymer solutions, with a so-called coagulant is used as coagulation bath liquid. The coagulant to be adopted should be unable to dissolve the aforementioned PAN copolymer and should be compatible with the solvent present in the PAN copolymer solution. Specific examples of the coagulant include water, methanol, ethanol, ethylene glycol, propylene glycol, and glycerin, of which water is the most preferred from the viewpoint of safety. For the coagulation bath liquid, an appropriate concentration may be adopted in consideration of the denseness and circularity of the coagulated fiber, but in using water as coagulant and using dimethyl sulfoxide, dimethyl formamide, or dimethyl acetamide as solvent, it is preferable for the solvent concentration to be 25 to 85 mass %, more preferably 70 to 85 mass %. When an aqueous zinc chloride solution or an aqueous sodium thiocyanate solution is used as coagulation bath liquid, it is preferable for the salt concentration to be 5 to 60 mass %. In general, as the organic solvent concentration or the salt concentration in a coagulation bath liquid increases, the coagulation bath liquid tends to increase in viscosity and the coagulation speed tends to decrease, which are likely to act as factors in causing a break of the spinning dope solution in the air gap or a break of the coagulating fiber bundle. When an aqueous zinc chloride solution or an aqueous sodium thiocyanate solution is used as coagulation bath liquid, it is preferable for the salt concentration to be 5 to 60 mass % to greatly enhance the desired effect.

There are no specific limitations on the material, shape, size and the like of the guide immersed in the coagulation bath to be used as long as it is of a common type for conventional dry-jet wet spinning processes, but it is desirable to adopt a guide part suffering as smaller a friction as possible with the coagulating fiber bundle because such a guide part can prevent a break of the coagulating fiber bundle. To reduce the guide resistance, it is good to adopt a roller type guide part.

Extrusion Angle

The angle (A) between the straight line running from the spinneret hole located outermost in the take-up direction to the redirection point of the coagulating fiber bundle on the first guide immersed in the coagulation bath and the straight line perpendicular to the spinneret face is preferably set at 6.5° to 45°. The angle (A) between the straight line running from the spinneret hole located outermost in the take-up direction to the redirection point of the coagulating fiber bundle on the first guide immersed in the coagulation bath and the straight line perpendicular to the spinneret face will be occasionally referred to simply as the angle (A). The angle (A) is the angle denoted by the number 11 in FIGS. 1 and 2. The angle (A) can be calculated as described below.

Angle ($A$)=arctan {(distance from the spinneret hole located outermost in the take-up direction to the spinneret center)/(depth-directional coagulation bath immersion length+air gap length)}

The air gap length means the distance denoted by the number 7 in FIGS. 1 and 2, that is, the distance from the spinneret to the original liquid surface of the coagulation bath liquid, which is measured before the surface is dragged down by the accompanying flow generated by the spinning dope solution traveling in the depth direction of the coagulation bath. The distance from the spinneret hole located outermost in the take-up direction to the spinneret center, the depth-directional coagulation bath immersion length, and the air gap length can be determined by, for example, measurement with a tape measure. If the angle (A) is too small, the traveling spinning dope solution broadens to cause stronger accompanying flow that will induce a break of the coagulating fiber bundle, whereas if it is too large, the extrusion angle of the spinning dope solution becomes so large that the spinning dope solution 2*a* extruded from the spinneret will be broken in the air gap. Accordingly, it is more preferably 8° to 40°, still more preferably 10° to 35°. An excessively large air gap length will cause the spinning dope solution 2*a* extruded from the spinneret to be broken in the air gap and accordingly, it is preferably 1 to 50 mm.

Take-Up Speed of Spinning Dope Solution

The take-up speed to pull the spinning dope solution so that the PAN copolymer solution is introduced into the coagulation bath liquid to form a coagulating fiber bundle (commonly equal to the take-up speed to pull the coagulating fiber bundle) is preferably 10 m/min or more. The take-up speed for the spinning dope solution is the surface speed of the first roller having a drive source the spinning dope solution exiting out of the spinneret or the coagulating fiber bundle comes in contact with. A faster take-up speed for spinning dope solution acts more frequently to cause the spinning dope solution extruded from the spinneret to be broken in the air gap or cause the coagulating fiber bundle to be broken in the coagulation bath liquid. This means that appropriate control of this condition allows the desired effect to be realized more easily. There are no specific limitations on the spinning draft ratio, and an appropriate ratio may be adopted to suit the fineness of the precursor fiber for carbon fiber to be produced. The spinning draft ratio can be calculated as described below.

spinning draft ratio=(take-up speed for spinning dope solution/linear extrusion speed)

The linear extrusion speed is calculated by dividing the volume of the spinning dope solution extruded from the spinneret per unit time by the area of the spinneret hole.

Washing Step in Water, Stretching Step, Oil Agent Applying Step, and Drying Step As described above, a PAN copolymer solution, which is used as spinning dope solution, is introduced into a coagulation bath liquid, coagulated to form a coagulated fiber bundle, and subjected to a washing step in water, stretching step, oil agent applying step, and drying step to provide a precursor fiber for carbon fiber. In this process, the stretching step may be performed in the coagulation bath liquid.

In addition, a dry heat stretching step or a steam stretching step may be performed after the drying step. Commonly, the drawing in water step can be carried out in a single stretching bath or multiple stretching baths that are controlled at temperatures of 30° C. to 98° C. It is preferable for the drawing in water ratio to be 2 to 6. After the drawing in water step, it is preferable for the stretched fibers to be provided with an oil agent containing, for example, silicone with the aim of preventing adhesion between the single filaments. It is preferable for the above silicone oil agent to contain a modified silicone such as amino-modified silicone with high heat resistance. The subsequent drying step may be performed by using a generally known method. Furthermore, it is preferable for the drying step to be followed by stretching in a heated heating medium to improve the productivity or increase the orientation parameter of crystallites. For example, pressurized steam or overheated steam is used suitably as the heated heating medium to ensure stable operation and low cost.

Carbon Fiber Production Method

Described next is the carbon fiber production method. The precursor fiber for carbon fiber produced by the procedure described above is then subjected favorably to stabilization treatment in an oxidizing atmosphere at a temperature of 200° C. to 300° C., subjected favorably to preliminary carbonization treatment in an inert atmosphere at a temperature of 500° C. to 1,200° C., and then subjected favorably to carbonization treatment in an inert atmosphere at a temperature of up to 1,200° C. to 3,000° C., thereby providing a carbon fiber.

Air is preferably adopted as oxidizing atmosphere for the stabilization treatment. Preliminary carbonization treatment and carbonization treatment are performed in an inert atmosphere. Examples of the gas used for an inert atmosphere include nitrogen, argon, and xenon, of which nitrogen is preferable from an economical point of view. When carbon fiber with higher elastic modulus is desired, graphitization may be performed after the carbonization step. The graphitization step is preferably performed at a temperature of 2,000° C. to 3,000° C.

Surface Modification Step

For surface modification, the resulting carbon fiber may be subjected to electrolytic treatment. Such electrolytic treatment ensures better adhesion to the matrix for carbon fiber in the final fiber reinforced composite material. The electrolytic treatment step may be followed by sizing treatment to allow the carbon fiber to have high convergency. For the sizing step, a sizing agent having high compatibility with the matrix resin may be selected appropriately in consideration of the type of matrix resin used.

EXAMPLES

Our methods and carbon fibers will now be illustrated in more detail with reference to examples, but it should be understood that this disclosure is not limited to the examples described herein.

Example 1

Spinning Dope Solution

Acrylonitrile and itaconic acid are added in dimethyl sulfoxide, which is adopted as solvent, and copolymerized by the solution polymerization method using a polymerization initiator to produce a polyacrylonitrile based copolymer, which is then used to provide a spinning dope solution with a polymer concentration of 21 mass %.

Spinneret

A spinneret incorporating a spinneret hole-containing region having a 6 cm short side and 1,000 holes is disposed such that the short side is in the take-up direction and the air gap length is 5 mm with the length of the spinneret in the take-up direction being 6 cm.

Coagulation Bath Liquid

Dimethyl sulfoxide and water, which was adopted as coagulant, were mixed at a ratio of 25 mass % and 75 mass %, and the mixture was used as coagulation bath liquid.

Spinning

The spinning dope solution prepared above was extruded from the aforementioned spinneret into the air and immersed in the coagulation bath liquid at a controlled temperature of 5° C., and the resulting coagulated fiber bundle was taken up in the spinning setup of the example (1). The depth-directional coagulation bath immersion length was 10 cm and the coagulation bath immersion length was 160 cm. The coagulation bath liquid had a viscosity of 7 mPa·s. The angle (A) between the coagulating fiber bundle and the guide part was 15.9° and the redirection angle (B) was 86°. When the take-up speed for spinning dope solution was increased while maintaining a constant spinning draft ratio, the critical take-up speed, that is, the take-up speed at which the spinning dope solution extruded from the spinneret was broken in the air gap or the coagulating fiber bundle was broken in the coagulation bath liquid, was found to be 46 m/min.

Example 2

Except for adjusting the depth-directional coagulation bath immersion length to 20 cm, the same procedure as in Example 1 was carried out.

Example 3

Except for using a spinneret having a 9 cm short side and 5,000 holes and adjusting the depth-directional coagulation bath immersion length to 5 cm, the same procedure as in Example 1 was carried out.

Example 4

Except for adjusting the depth-directional coagulation bath immersion length to 15 cm, the same procedure as in Example 3 was carried out.

Example 5

Except for adjusting the depth-directional coagulation bath immersion length to 35 cm, the same procedure as in Example 3 was carried out.

Example 6

Except for adjusting the depth-directional coagulation bath immersion length to 5 cm and adjusting the coagulation bath immersion length to 15 cm, the same procedure as in Example 3 was carried out.

Example 7

Except for using a spinneret having a 15 cm short side and 10,000 holes and adjusting the depth-directional coagulation bath immersion length to 10 cm, the same procedure as in Example 1 was carried out.

Example 8

Except for using a spinneret having a 18 cm short side and 16,000 holes and adjusting the depth-directional coagulation bath immersion length to 15 cm, the same procedure as in Example 1 was carried out.

Example 9

Except for using a mixture of dimethyl sulfoxide and water mixed at a ratio of 70 mass % and 30 mass % as coagulation bath liquid, the same procedure as in Example 1 was carried out. The coagulation bath liquid had a viscosity of 12 mPa·s. The coagulation bath liquid had a high organic solvent concentration and accordingly the critical take-up speed was lower than in a low organic solvent concentration, but compared to Comparative example 5, which will be described later, the critical take-up speed was found to increase by a large increment of 13 m/min.

Example 10

Except for using a mixture of dimethyl sulfoxide and water mixed at a ratio of 80 mass % and 20 mass % as coagulation bath liquid, the same procedure as in Example 1 was carried out. The coagulation bath liquid had a viscosity of 11 mPa·s. Compared to Comparative example 6, which will be described later, the critical take-up speed increased by a large increment of 15 m/min.

Example 11

Except for using a mixture of dimethyl sulfoxide and water mixed at a ratio of 85 mass % and 15 mass % as coagulation bath liquid, the same procedure as in Example 1 was carried out. The coagulation bath liquid had a viscosity of 11 mPa·s. Compared to Comparative example 7, which will be described later, the critical take-up speed increased by a large increment of 16 m/min.

Example 12

Except for using a mixture of dimethyl sulfoxide, water, and glycerin (Gly) mixed at a ratio of 55 mass %, 20 mass %, and 25 mass % as coagulation bath liquid and controlling the temperature at −5° C., the same procedure as in Example 1 was carried out. The coagulation bath liquid had a viscosity of 42 mPa·s. Compared to Comparative example 8, which will be described later, the critical take-up speed increased by a large increment of 17 m/min.

Example 13

Except for using dimethyl formamide as solvent for the polyacrylonitrile based copolymer solution, using a mixture of dimethyl formamide and water mixed at a ratio of 80 mass % and 20 mass % as coagulation bath liquid, and controlling the temperature at −5° C., the same procedure as in Example 1 was carried out. The coagulation bath liquid had a viscosity of 10 mPa·s. Compared to Comparative example 9, which will be described later, the critical take-up speed increased by a large increment of 17 m/min.

Example 14

Except for using dimethyl acetamide as solvent for the polyacrylonitrile based copolymer solution, using a mixture of dimethyl acetamide and water mixed at a ratio of 80 mass % and 20 mass % as coagulation bath liquid, and controlling the temperature at 5° C., the same procedure as in Example 1 was carried out. The coagulation bath liquid had a viscosity of 12 mPa·s. Compared to Comparative example 10, which will be described later, the critical take-up speed increased by a large increment of 16 m/min.

Example 15

Except for using a mixture of dimethyl sulfoxide and water mixed at a ratio of 5 mass % and 95 mass % as coagulation bath liquid and controlling the temperature at 25° C., the same procedure as in Example 1 was carried out. The coagulation bath liquid had a viscosity of 2 mPa·s.

Example 16

Except for adopting the spinning setup of the example (2) and adjusting the depth-directional coagulation bath immersion length, the first oblique-directional coagulation bath immersion length, and the depth of the second guide immersed in the coagulation bath to 35 cm, 100 cm, and 15 cm, respectively, the same procedure as in Example 5 was carried out. The redirection angle (B) was 78°, which was larger by 4° than in Example 5.

Example 17

Except for adjusting the depth of the second guide immersed in the coagulation bath to 35 cm, the same procedure as in Example 16 was carried out. The redirection angle (B) was 90°.

Example 18

Except for adjusting the first oblique-directional coagulation bath immersion length to 40 cm and adjusting the depth of the second guide immersed in the coagulation bath to 50 cm, the same procedure as in Example 16 was carried out. The redirection angle (B) was 112°.

Example 19

Except for adjusting the depth of the second guide immersed in the coagulation bath to 60 cm, the same procedure as in Example 18 was carried out. The redirection angle (B) was 129°.

Example 20

Except for adjusting the depth of the second guide immersed in the coagulation bath to 68 cm, the same procedure as in Example 18 was carried out. The redirection angle (B) was 146°.

Example 21

Except for adjusting the depth-directional coagulation bath immersion length to 15 cm, the same procedure as in Example 16 was carried out. The redirection angle (B) was 90°.

Example 22

Except for adjusting the depth of the second guide immersed in the coagulation bath to 60 cm, the same procedure as in Example 21 was carried out. The redirection angle (B) was 117°.

Example 23

Except for adjusting the depth-directional coagulation bath immersion length to 5 cm, the same procedure as in Example 16 was carried out. The redirection angle (B) was 90°.

Example 24

Except for adjusting the depth of the second guide immersed in the coagulation bath to 60 cm, the same procedure as in Example 23 was carried out. The redirection angle (B) was 123°.

Example 25

Except for adopting the spinning setup of the example (2) and adjusting the depth-directional coagulation bath immersion length, the first oblique-directional coagulation bath immersion length, and the depth of the second guide immersed in the coagulation bath to 10 cm, 100 cm, and 10 cm, respectively, the same procedure as in Example 10 was carried out. The redirection angle (B) was 90°.

Example 26

Except for adjusting the first oblique-directional coagulation bath immersion length to 40 cm and adjusting the depth of the second guide immersed in the coagulation bath to 25 cm, the same procedure as in Example 25 was carried out. The redirection angle (B) was 112°.

Example 27

Except for using a mixture of dimethyl sulfoxide and water mixed at a ratio of 70 mass % and 30 mass % as coagulation bath liquid, the same procedure as in Example 25 was carried out. The redirection angle (B) was 90°.

Example 28

Except for using a mixture of dimethyl sulfoxide and water mixed at a ratio of 80 mass % and 20 mass % as coagulation bath liquid, the same procedure as in Example 21 was carried out. The redirection angle (B) was 90°.

Comparative Example 1

Except for adjusting the depth-directional coagulation bath immersion length to 60 cm, the same procedure as in Example 1 was carried out. The critical take-up speed decreased by 11 m/min compared to Example 1 where the immersion depth was set to 10 cm.

Comparative Example 2

Except for adjusting the depth-directional coagulation bath immersion length to 60 cm, the same procedure as in Example 3 was carried out.

Comparative Example 3

Except for using a spinneret having a 25 cm short side and 18,000 holes, the same procedure as Comparative example 2 was carried out.

Comparative Example 4

Except for using a spinneret having a 25 cm short side and 21,000 holes, the same procedure as Comparative example 3 was carried out.

Comparative Example 5

Except for adjusting the depth-directional coagulation bath immersion length to 60 cm, the same procedure as in Example 9 was carried out. The critical take-up speed decreased by 13 m/min compared to Example 9 where the immersion depth was set to 10 cm.

Comparative Example 6

Except for adjusting the depth-directional coagulation bath immersion length to 60 cm, the same procedure as in Example 10 was carried out. The critical take-up speed decreased by 15 m/min compared to Example 10 where the immersion depth was set to 10 cm.

Comparative Example 7

Except for adjusting the depth-directional coagulation bath immersion length to 60 cm, the same procedure as in Example 11 was carried out. The critical take-up speed decreased by 16 m/min compared to Example 11 where the immersion depth was set to 10 cm.

Comparative Example 8

Except for adjusting the depth-directional coagulation bath immersion length to 60 cm, the same procedure as in Example 12 was carried out. The critical take-up speed decreased by 17 m/min compared to Example 12 where the immersion depth was set to 10 cm.

Comparative Example 9

Except for adjusting the depth-directional coagulation bath immersion length to 60 cm, the same procedure as in Example 13 was carried out. The critical take-up speed decreased by 17 m/min compared to Example 13 where the immersion depth was set to 10 cm.

Comparative Example 10

Except for adjusting the depth-directional coagulation bath immersion length to 60 cm, the same procedure as in Example 14 was carried out. The critical take-up speed decreased by 16 m/min compared to Example 14 where the immersion depth was set to 10 cm.

Comparative Example 11

Except for using a mixture of dimethyl sulfoxide and water mixed at a ratio of 80 mass % and 20 mass % as coagulation bath liquid, the same procedure as in Comparative example 2 was carried out.

Comparative Example 12

Except for adjusting the depth-directional immersion length to 60 cm and adjusting the depth of the second guide immersed in the coagulation bath to 60 cm, the same procedure as in Example 28 was carried out.

Comparative Example 13

Except for adjusting the depth-directional immersion length to 60 cm and adjusting the depth of the second guide immersed in the coagulation bath to 60 cm, the same procedure as in Example 17 was carried out.

Comparative Example 14

Except for adjusting the depth-directional immersion length to 45 cm and adjusting the depth of the second guide immersed in the coagulation bath to 45 cm, the same procedure as in Example 17 was carried out.

In the Tables below, dimethyl sulfoxide, glycerin, dimethyl formamide, and dimethyl acetamide are abbreviated as DMSO, Gly, DMF, and DMAC, respectively.

TABLE 1

| | Spinneret | | Coagulation bath liquid | | | | Coagulation bath immersion conditions | | | | | |
|---|---|---|---|---|---|---|---|---|---|---|---|---|
| | length in take-up direction (cm) | number of holes (number) | coagulation bath liquid | coagulation bath temperature (° C.) | coagulation bath liquid viscosity (mPa · s) | example | depth-directional coagulation bath immersion length (cm) | oblique-directional coagulation bath immersion length (cm) | coagulation bath immersion length (cm) | angle (A) | redirection angle (B) | critical take-up speed (m/min) |
| Example 1 | 6 | 1,000 | water 75/ DMSO 25 | 5 | 7 | (1) | 10 | 150 | 160 | 15.9 | 86 | 46 |
| Example 2 | 6 | 1,000 | water 75/ DMSO 25 | 5 | 7 | (1) | 20 | 140 | 160 | 8.3 | 82 | 45 |
| Example 3 | 9 | 5,000 | water 75/ DMSO 25 | 5 | 7 | (1) | 5 | 155 | 160 | 39.3 | 88 | 47 |
| Example 4 | 9 | 5,000 | water 75/ DMSO 25 | 5 | 7 | (1) | 15 | 145 | 160 | 16.2 | 84 | 45 |
| Example 5 | 9 | 5,000 | water 75/ DMSO 25 | 5 | 7 | (1) | 35 | 125 | 160 | 7.2 | 74 | 38 |
| Example 6 | 9 | 5,000 | water 75/ DMSO 25 | 5 | 7 | (1) | 5 | 10 | 15 | 39.3 | 60 | 46 |
| Example 7 | 15 | 10,000 | water 75/ DMSO 25 | 5 | 7 | (1) | 10 | 150 | 160 | 35.5 | 86 | 44 |

TABLE 2

| | spinneret | | coagulation bath liquid | | | | coagulation bath immersion conditions | | | | | |
|---|---|---|---|---|---|---|---|---|---|---|---|---|
| | length in take-up direction (cm) | number of holes (number) | coagulation bath liquid | coagulation bath temperature (° C.) | coagulation bath liquid viscosity (mPa · s) | example | depth-directional coagulation bath immersion length (cm) | oblique-directional coagulation bath immersion length (cm) | coagulation bath immersion length (cm) | angle (A) | redirection angle (B) | critical take-up speed (m/min) |
| Example 8 | 18 | 16,000 | water 75/ DMSO 25 | 5 | 7 | (1) | 15 | 145 | 160 | 30.1 | 84 | 42 |
| Example 9 | 6 | 1,000 | water 30/ DMSO 70 | 5 | 12 | (1) | 10 | 150 | 160 | 15.9 | 86 | 37 |
| Example 10 | 6 | 1,000 | water 20/ DMSO 80 | 5 | 11 | (1) | 10 | 150 | 160 | 15.9 | 86 | 37 |
| Example 11 | 6 | 1,000 | water 15/ DMSO85 | 5 | 11 | (1) | 10 | 150 | 160 | 15.9 | 86 | 34 |
| Example 12 | 6 | 1,000 | water 20/ DMSO 55/ Gly 25 | −5 | 42 | (1) | 10 | 150 | 160 | 15.9 | 86 | 31 |
| Example 13 | 6 | 1,000 | water 20/ DMF 80 | −5 | 10 | (1) | 10 | 150 | 160 | 15.9 | 86 | 35 |
| Example 14 | 6 | 1,000 | water 20/ DMAC 80 | 5 | 12 | (1) | 10 | 150 | 160 | 15.9 | 86 | 35 |
| Example 15 | 6 | 1,000 | water 95/ DMSO 5 | 25 | 2 | (1) | 10 | 150 | 160 | 15.9 | 86 | 48 |

TABLE 3

| | Spinneret | | Coagulation bath liquid | | | | Coagulation bath immersion conditions | |
|---|---|---|---|---|---|---|---|---|
| | length in take-up direction (cm) | number of holes (number) | coagulation bath liquid | coagulation bath temperature (° C.) | bath liquid viscosity (mPa · s) | example | depth-directional coagulation bath immersion length (cm) | oblique-directional coagulation bath immersion length (cm) |
| Example 16 | 9 | 5,000 | water 75/ DMSO 25 | 5 | 7 | (2) | 35 | — |
| Example 17 | 9 | 5,000 | water 75/ DMSO 25 | 5 | 7 | (2) | 35 | — |
| Example 18 | 9 | 5,000 | water 75/ DMSO 25 | 5 | 7 | (2) | 35 | — |
| Example 19 | 9 | 5,000 | water 75/ DMSO 25 | 5 | 7 | (2) | 35 | — |
| Example 20 | 9 | 5,000 | water 75/ DMSO 25 | 5 | 7 | (2) | 35 | — |
| Example 21 | 9 | 5,000 | water 75/ DMSO 25 | 5 | 7 | (2) | 15 | — |
| Example 22 | 9 | 5,000 | water 75/ DMSO 25 | 5 | 7 | (2) | 15 | — |
| Example 23 | 9 | 5,000 | water 75/ DMSO 25 | 5 | 7 | (2) | 5 | — |
| Example 24 | 9 | 5,000 | water 75/ DMSO 25 | 5 | 7 | (2) | 5 | — |
| Example 25 | 6 | 1,000 | water 20/ DMSO 80 | 5 | 11 | (2) | 10 | — |
| Example 26 | 6 | 1,000 | water 20/ DMSO 80 | 5 | 11 | (2) | 10 | — |
| Example 27 | 6 | 1,000 | water 30/ DMSO 70 | 5 | 12 | (2) | 10 | — |
| Example 28 | 9 | 5,000 | water 20/ DMSO 80 | 5 | 11 | (2) | 15 | — |

| | Coagulation bath immersion conditions | | | | | |
|---|---|---|---|---|---|---|
| | first oblique-directional coagulation bath immersion length (cm) | coagulation bath immersion length (cm) | depth of second guide immersed in the coagulation bath (cm) | angle (A) | redirection angle (B) | critical take-up speed (m/min) |
| Example 16 | 100 | — | 15 | 7.2 | 78 | 40 |
| Example 17 | 100 | — | 35 | 7.2 | 90 | 48 |
| Example 18 | 40 | — | 50 | 7.2 | 112 | 46 |
| Example 19 | 40 | — | 60 | 7.2 | 129 | 44 |
| Example 20 | 40 | — | 68 | 7.2 | 146 | 41 |
| Example 21 | 100 | — | 15 | 16.2 | 90 | 52 |
| Example 22 | 100 | — | 60 | 16.2 | 117 | 49 |
| Example 23 | 100 | — | 5 | 39.3 | 90 | 53 |
| Example 24 | 100 | — | 60 | 39.3 | 123 | 49 |
| Example 25 | 100 | — | 10 | 15.9 | 90 | 43 |
| Example 26 | 40 | — | 25 | 15.9 | 112 | 42 |
| Example 27 | 100 | — | 10 | 15.9 | 90 | 44 |
| Example 28 | 100 | — | 15 | 16.2 | 90 | 41 |

TABLE 4

| | spinneret | | coagulation bath liquid | | | coagulation bath immersion conditions | | |
|---|---|---|---|---|---|---|---|---|
| | length in take-up direction (cm) | number of holes (number) | coagulation bath liquid | coagulation bath temperature (° C.) | bath liquid viscosity (mPa · s) | example | depth-directional coagulation bath immersion length (cm) | oblique-directional coagulation bath immersion length (cm) |
| Comparative example 1 | 6 | 1,000 | water 75/ DMSO 25 | 5 | 7 | (1) | 60 | 100 |
| Comparative example 2 | 9 | 5,000 | water 75/ DMSO 25 | 5 | 7 | (1) | 60 | 100 |
| Comparative example 3 | 25 | 18,000 | water 75/ DMSO 25 | 5 | 7 | (1) | 60 | 100 |
| Comparative example 4 | 25 | 21,000 | water 75/ DMSO 25 | 5 | 7 | (1) | 60 | 100 |
| Comparative example 5 | 6 | 1,000 | water 30/ DMSO70 | 5 | 12 | (1) | 60 | 100 |
| Comparative example 6 | 6 | 1,000 | water 20/ DMSO80 | 5 | 11 | (1) | 60 | 100 |
| Comparative example 7 | 6 | 1,000 | water 15/ DMSO85 | 5 | 11 | (1) | 60 | 100 |
| Comparative example 8 | 6 | 1,000 | water 20/ DMSO55/ Gly25 | −5 | 42 | (1) | 60 | 100 |
| Comparative example 9 | 6 | 1,000 | water 20/ DMF80 | −5 | 10 | (1) | 60 | 100 |
| Comparative example 10 | 6 | 1,000 | water 20/ DMAC80 | 5 | 12 | (1) | 60 | 100 |
| Comparative example 11 | 9 | 5,000 | water 20/ DMSO80 | 5 | 11 | (1) | 60 | 100 |
| Comparative example 12 | 9 | 5,000 | water 20/ DMSO80 | 5 | 11 | (2) | 60 | — |
| Comparative example 13 | 9 | 5,000 | water 75/ DMSO 25 | 5 | 7 | (2) | 60 | — |
| Comparative example 14 | 9 | 5,000 | water 75/ DMSO 25 | 5 | 7 | (2) | 45 | — |

| | coagulation bath immersion conditions | | | | | |
|---|---|---|---|---|---|---|
| | first oblique-directional coagulation bath immersion length (cm) | coagulation bath immersion length (cm) | depth of second guide immersed in the coagulation bath (cm) | angle (A) | redirection angle (B) | critical take-up speed (m/min) |
| Comparative example 1 | — | 160 | — | 2.8 | 53 | 35 |
| Comparative example 2 | — | 160 | — | 4.3 | 53 | 32 |
| Comparative example 3 | — | 160 | — | 11.7 | 53 | 30 |
| Comparative example 4 | — | 160 | — | 11.7 | 53 | 26 |
| Comparative example 5 | — | 160 | — | 2.8 | 53 | 24 |
| Comparative example 6 | — | 160 | — | 2.8 | 53 | 22 |
| Comparative example 7 | — | 160 | — | 2.8 | 53 | 18 |
| Comparative example 8 | — | 160 | — | 2.8 | 53 | 14 |
| Comparative example 9 | — | 160 | — | 2.8 | 53 | 18 |
| Comparative example 10 | — | 160 | — | 2.8 | 53 | 19 |
| Comparative example 11 | — | 160 | — | 4.3 | 53 | 18 |
| Comparative example 12 | 100 | — | 60 | 4.3 | 90 | 19 |
| Comparative example 13 | 100 | — | 60 | 4.3 | 90 | 32 |
| Comparative example 14 | 100 | — | 45 | 5.6 | 90 | 34 |

The invention claimed is:

1. A method of producing a precursor fiber for carbon fiber comprising:

extruding a spinning dope solution comprising a polyacrylonitrile copolymer solution from a spinneret into the air, immersing the spinning dope solution in a coagulation bath liquid stored in a coagulation bath to obtain a coagulating fiber bundle, redirecting traveling of the coagulating fiber bundle by a first guide immersed in the coagulation bath disposed below the spinneret, and pulling the coagulating fiber bundle out of the coagulation bath liquid into the air to prepare a coagulated fiber bundle, which is then subjected to at least a washing step in water, stretching step, oil agent applying step, and drying step, wherein a depth-directional coagulation bath immersion length, which means a distance between a starting point of the immersion of the spinning dope solution in the coagulation bath liquid and the first guide immersed in the coagulation bath where traveling of the coagulating fiber bundle is redirected, is 3 to 40 cm, wherein the coagulating fiber bundle redirected by the first guide immersed in the coagulation bath is redirected again at least by a second guide immersed in the coagulation bath, the second guide being immersed in the coagulation bath and located in the coagulation solution below a straight line running from an exit point where the coagulating fiber bundle is pulled out into the air to the first guide immersed in the coagulation bath, wherein a redirection angle (B) of the coagulating fiber bundle on the first guide immersed in the coagulation bath is 90° to 150°.

2. The method as set forth in claim 1, wherein the coagulation bath immersion length, which is a sum of the depth-directional coagulation bath immersion length and an oblique-directional coagulation bath immersion length, is 10 to 500 cm, the oblique-directional coagulation bath immersion length being a distance between the first guide immersed in the coagulation bath where traveling of the coagulating fiber bundle is redirected and the exit point where it is pulled out into the air.

3. The method as set forth in claim 1, wherein the first oblique-directional coagulation bath immersion length is 10 to 300 cm, the first oblique-directional coagulation bath immersion length being a distance between the first guide immersed in the coagulation bath where the coagulating fiber bundle is redirected and the second guide immersed in the coagulation bath where it is redirected again.

4. The method as set forth in claim 1, wherein an angle (A), the angle between the straight line running from the spinneret hole located outermost in a take-up direction to the redirection point of the coagulating fiber bundle on the first guide immersed in the coagulation bath and the straight line perpendicular to the spinneret face, is 6.5° to 45°.

5. The method as set forth in claim 1, wherein a length of the spinneret in the take-up direction is 5 to 20 cm.

6. The method as set forth in claim 1, wherein the spinneret has 500 to 24,000 holes.

7. The method as set forth in claim 1, wherein a take-up speed for the spinning dope solution is 10 m/min or more.

8. The method as set forth in claim 1, wherein the coagulation bath liquid has a viscosity of 2 to 100 mPa·s.

9. The method as set forth in claim 1, wherein the coagulation bath liquid is a liquid mixture of water and at least one solvent selected from the group consisting of dimethyl sulfoxide, dimethyl formamide, and dimethyl acetamide and has a solvent concentration of 25 to 85 mass %.

10. A method of producing carbon fiber comprising steps in which a precursor fiber for carbon fiber prepared by the method as set forth in claim 1 is subjected to stabilization treatment in an oxidizing atmosphere at a temperature of 200° C. to 300° C., preliminary carbonization treatment in an inert atmosphere at a temperature of 500° C. to 1,200° C., and then carbonization treatment in an inert atmosphere at a temperature of 1,200° C. to 3,000° C.

* * * * *